US011848145B2

(12) United States Patent
Ohaga

(10) Patent No.: US 11,848,145 B2
(45) Date of Patent: Dec. 19, 2023

(54) COIL AND INDUCTOR INCLUDING THE SAME

(71) Applicant: Murata Manufacturing Co., Ltd., Kyoto-fu (JP)

(72) Inventor: Takeo Ohaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 502 days.

(21) Appl. No.: 17/067,355

(22) Filed: Oct. 9, 2020

(65) Prior Publication Data

US 2021/0110964 A1 Apr. 15, 2021

(30) Foreign Application Priority Data

Oct. 11, 2019 (JP) ..... 2019-187761

(51) Int. Cl.

| | |
|---|---|
| ***H01F 27/28*** | (2006.01) |
| ***H01F 27/29*** | (2006.01) |
| ***H01F 27/32*** | (2006.01) |
| ***H01F 17/04*** | (2006.01) |

(52) U.S. Cl.

CPC ..... *H01F 27/2828* (2013.01); *H01F 17/045* (2013.01); *H01F 27/292* (2013.01); *H01F 27/324* (2013.01); *H01F 2017/048* (2013.01)

(58) Field of Classification Search

CPC .. H01F 27/2828; H01F 17/045; H01F 27/292; H01F 27/324; H01F 2017/048; H01F 27/2823; H01F 17/04; H01F 27/255; H01F 27/2847

See application file for complete search history.

(56) References Cited

U.S. PATENT DOCUMENTS

| | | | | |
|---|---|---|---|---|
| 7,339,451 B2 * | 3/2008 | Liu | ..... | H01F 27/027 336/200 |
| 2019/0088407 A1 | 3/2019 | Jung et al. | | |
| 2019/0198235 A1 | 6/2019 | Yang et al. | | |

FOREIGN PATENT DOCUMENTS

| | | |
|---|---|---|
| CN | 1674172 A | 9/2005 |
| CN | 109524211 A | 3/2019 |

OTHER PUBLICATIONS

An Office Action mailed by China National Intellectual Property Administration dated Mar. 3, 2022, which corresponds to Chinese Patent Application No. 202011083425.5 and is related to U.S. Appl. No. 17/067,355 with English language translation.

* cited by examiner

*Primary Examiner* — Tuyen T Nguyen
(74) *Attorney, Agent, or Firm* — Studebaker & Brackett PC

(57) ABSTRACT

A coil includes a winding section that are formed by winding a conductive wire having an insulating cover and a pair of opposite principal surfaces into an upper stage and a lower stage that are connected to each other by an innermost turn of the conductive wire that serves as a transition section while both ends of the conductive wire are located at an outermost turn of the conductive wire. The coil also includes a pair of lead-out portions that are taken from respective outermost turns of the upper stage and the lower stage and that continue to respective ends of the conductive wire. In the coil, at least part of the transition section includes a widened portion, and a width of the widened portion of the conductive wire is greater than a width of the conductive wire at a position other than the widened portion.

20 Claims, 4 Drawing Sheets

COIL AND INDUCTOR INCLUDING THE SAME

CROSS-REFERENCE TO RELATED APPLICATIONS

This application claims benefit of priority to Japanese Patent Application No. 2019-187761, filed Oct. 11, 2019, the entire content of which is incorporated herein by reference.

BACKGROUND

Technical Field

The present disclosure relates to a coil and also to an inductor that includes the coil.

Background Art

An inductor is used as a chalk coil in a power supply circuit, such as a DC-DC converter. The inductor has a magnetic portion containing a magnetic powder and a resin and a coil formed by winding a conductive wire and embedded in the magnetic portion. Various types of coils can be used for the inductor. One type of coil is a so-called alpha-winding coil formed by winding a conductive wire having a rectangular cross section into upper and lower stages, as described, for example, in U. S. Patent Application Publication No. 2019/0198235. The upper and lower stages are connected to each other by an innermost turn of the conductive wire, and end portions of the conductive wire are taken out from outermost turns thereof.

While the inductor in which the alpha-winding coil is embedded as described above is used widely, the operating frequency of the DC-DC converter has increased and the inductance of the inductor has decreased in recent years in order to meet the demand for size reduction of power supply circuit. This leads to a reduction in the number of turns of the coil. In the case of an alpha-winding coil that has lead-out portions of the coil being taken out in opposite directions, the minimum number of turns is 2.5. On the other hand, in forming the alpha-winding coil, reducing the number of turns decreases an adhesion region of adjacent turns of the conductive wire, which makes it difficult to maintain the shape of the coil. More specifically, in the alpha-winding coil having a large number of turns, principal surfaces of turns of the conductive wire provide a sufficient adhesion region, which can maintain the shape of the coil easily. On the other hand, in an alpha-winding coil having a small number of turns, for example, 2.5 turns, the conductive wire is wound only by one turn or less in each of the upper stage and the lower stage. As a result, only the principal surface of innermost turn of the conductive wire that connects the upper and lower stages can mainly provide an adhesion region, which leads to a problem such as loosening of the coil.

SUMMARY

Accordingly, the present disclosure provides a coil that can maintain its shape despite having a small number of turns and also to provide an inductor that includes the coil.

According to an aspect of the present disclosure, a coil includes a winding section that are formed by winding a conductive wire having an insulating cover and a pair of opposite principal surfaces into an upper stage and a lower stage that are connected to each other by an innermost turn of the conductive wire that serves as a transition section while both ends of the conductive wire are located at an outermost turn of the conductive wire. The coil also includes a pair of lead-out portions that are taken from respective outermost turns of the upper stage and the lower stage and that continue to respective ends of the conductive wire. In the coil, at least part of the transition section includes a widened portion, and a width of the widened portion of the conductive wire is greater than a width of the conductive wire at a position other than the widened portion.

Other features, elements, characteristics and advantages of the present disclosure will become more apparent from the following detailed description of preferred embodiments of the present disclosure with reference to the attached drawings.

DETAILED DESCRIPTION

Figure 1:
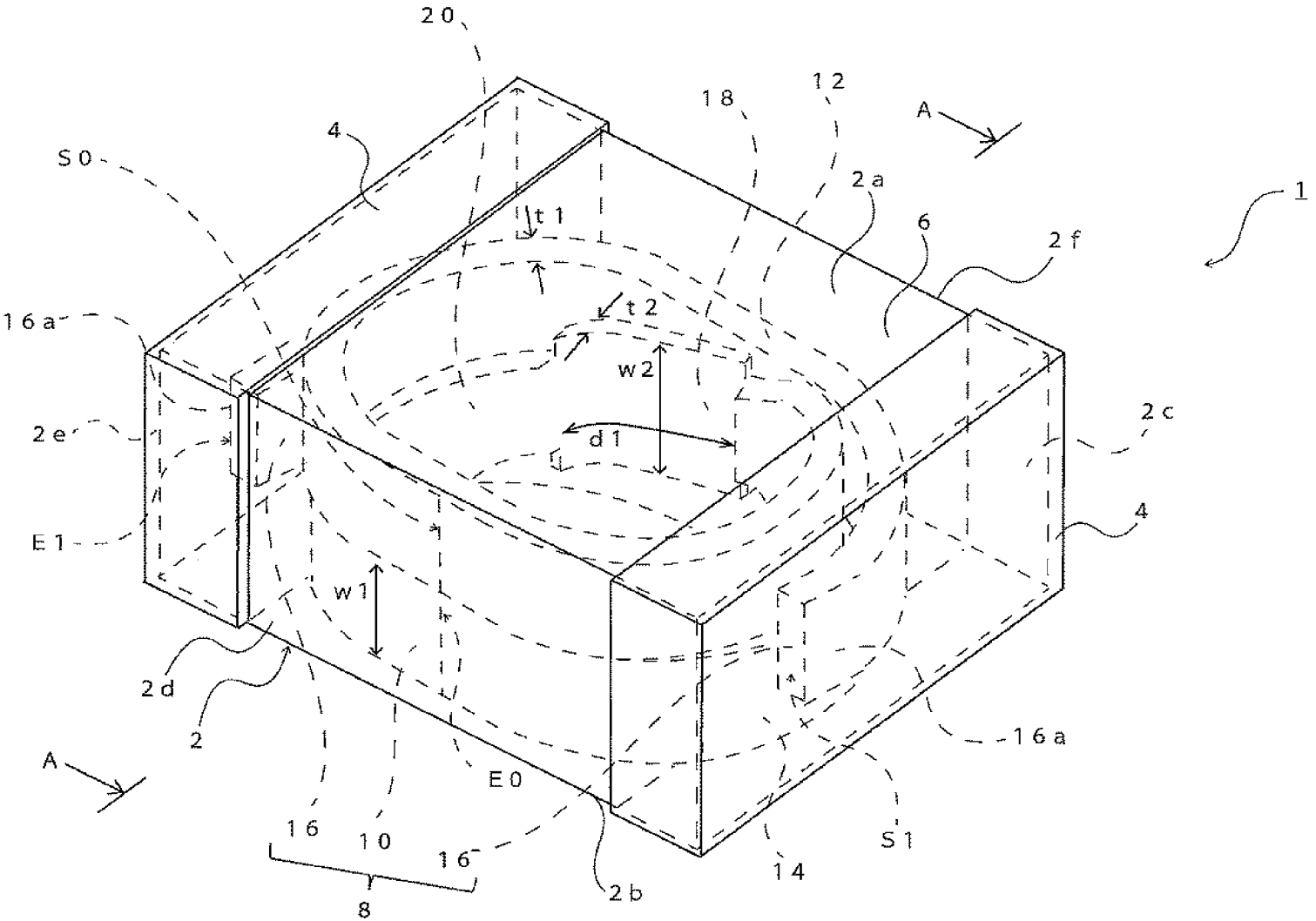
FIG. 1 is a perspective view illustrating an inductor that includes a coil according to an embodiment of the present disclosure.

Embodiments of the present disclosure will be described in detail with reference to the drawings. Note that terms related to specific directions and positions will be used when necessary in the following description (for example, "up", "down", "right", "left", and other terms containing such words). These terms are used for the sake of facilitating a clear understanding of the disclosure when it is described with reference to the drawings. These terms, however, are not intended to limit the technical scope of the present disclosure. Elements or members denoted by the same reference symbols in the drawings indicate that such elements or members are identical. Embodiments and examples described later are based on the preceding description of embodiments, and accordingly only differences will be described and duplicated description will be omitted. Advantageous effects obtained by a similar configuration will not be described repeatedly for each embodiment or example.

Figure 2:
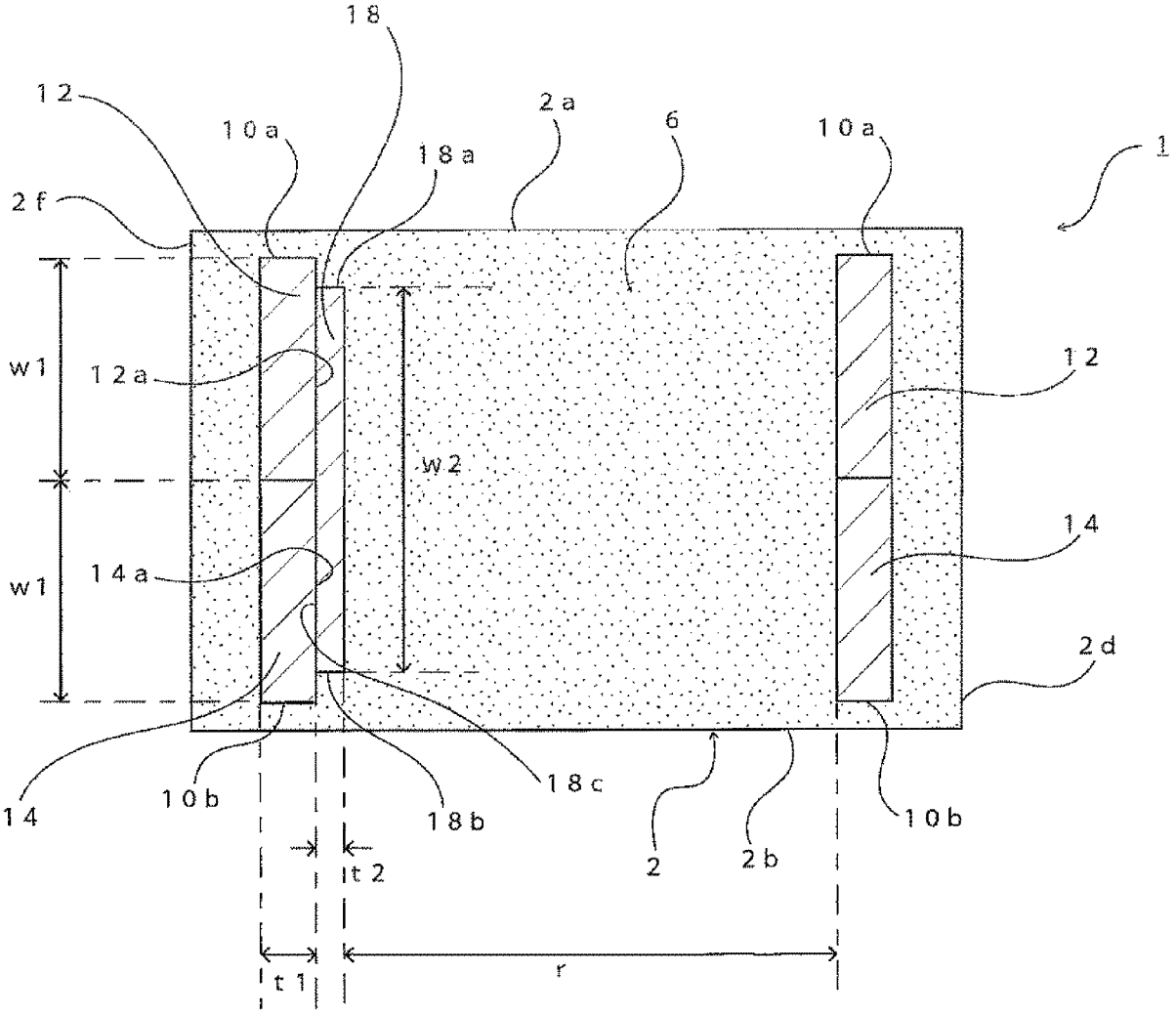
FIG. 2 is a cross section of the inductor taken along line A-A in FIG. 1.

An inductor 1 according to an embodiment of the present disclosure will be described with reference to FIGS. 1 and 2. FIG. 1 is a perspective view illustrating the inductor 1 according to an embodiment of the present disclosure. FIG. 2 is a cross-section of the inductor 1 taken along line A-A in FIG. 1.

As illustrated in FIG. 1, the inductor 1 according to the present embodiment includes a main body 2 and a pair of outer electrodes 4 disposed on surfaces of the main body 2. The main body 2 further includes a coil 8 and a magnetic portion 6 in which the coil 8 is embedded. The coil 8 further includes a winding section 10 and a pair of lead-out portions 16 that are taken out from the outermost turn in the winding section 10. The winding section 10 is formed by winding a single conductive wire. The winding section 10 is formed in such a manner that the conductive wire is wound into an upper stage 12 and lower stage 14 of the winding section 10. The upper stage 12 and the lower stage 14 are connected to each other by a transition section 20 that is the innermost turn of the conductive wire. A middle portion of the transition section 20 is a widened portion 18. In other words, at least part of the transition section 20 is the widened portion 18. A width w2 of widened portion 18 of the conductive wire is greater than a width w1 of the conductive wire at a position other than the widened portion 18. A pair of the lead-out portions 16 are taken out in opposite directions from respective outermost turns of the upper stage 12 and the lower stage 14. The lead-out portions 16 are electrically connected to respective outer electrodes 4.

Coil

The coil 8 is a so-called alpha-winding coil and includes the winding section 10 and a pair of the lead-out portions 16. The winding section 10 is shaped like an oval and formed by winding a conductive wire having a pair of opposite principal surfaces into upper and lower stages. The pair of lead-out portions 16 are taken out from the winding section 10.

The conductive wire of the coil 8 is a conductor that has a cover layer having insulation properties formed on the surface of the conductor and also has a fusing layer formed on the surface of the cover layer. The conductive wire has a pair of opposite principal surfaces and has a rectangular cross section (so-called "flat wire"). For example, the conductor is made of copper. The conductor has a width of 100 μm or more and 1000 μm or less (i.e., from 100 μm to 1000 μm) and a thickness of 10 μm or more and 200 μm or less (i.e., from 10 μm to 200 μm). The cover layer is made of an insulating resin, such as polyamide-imide, and has a thickness of, for example, 2 μm or more and 20 μm or less (i.e., from 2 μm to 20 μm), preferably 4 μm. The fusing layer is made, for example, of a thermoplastic resin or a thermosetting resin that contains an autohesion ingredient. The fusing layer is provided for fixing adjacent turns of conductive wire of the winding section 10 together. The fusing layer has a thickness, for example, of 0.5 μm or more and 4 μm or less (i.e., from 0.5 μm to 4 μm), preferably 1.5 μm. Accordingly, for example, the width w1 of the conductive wire, which is a dimension of the conductive wire in the width direction thereof, is 100 μm or more and 1100 μm or less (i.e., from 100 μm to 1100 μm), and a thickness t1 of the conductive wire is 15 μm or more and 250 μm or less (i.e., from 15 μm to 250 μm).

The upper stage 12 and the lower stage 14 of the winding section 10 are connected to each other by the transition section 20 of the conductive wire, which is the innermost turn of the conductive wire. The transition section 20 is a portion of the conductive wire that extends so as to be present both in the upper stage 12 and in the lower stage 14. In other words, the transition section 20 is one turn portion of the conductive wire that extends from arrow S0 to arrow E0 in FIG. 1. In addition, one of the lead-out portions 16 and the upper stage 12 is formed of a three-fourths turn portion of the conductive wire from arrow S0 to arrow S1, whereas the other one of the lead-out portions 16 and the lower stage 14 is formed of another three-fourths turn portion of the conductive wire from arrow E0 to arrow E1. In other words, the entire coil is formed by winding the conductive wire by 2.5 turns.

The transition section 20 includes the widened portion 18 that is formed by flattening a portion of the conductive wire of the coil 8. In the inductor illustrated in FIG. 1, the widened portion 18 is part of the transition section 20. However, the widened portion 18 may extend over the entire transition section 20. As illustrated in FIGS. 1 and 2, the width w2 of widened portion 18 of the conductive wire is greater than the width w1 of the conductive wire at a position other than the widened portion 18, and a thickness t2 of widened portion 18 of the conductive wire is smaller than the thickness t1 of the conductive wire at a position other than the widened portion 18. An outer principal surface 18*c* of the conductive wire in the widened portion 18 is in contact with inner principal surfaces 12*a* and 14*a* of the conductive wire in the upper stage 12 and in the lower stage 14. These principal surfaces are adhered to each other by the fusing layer of the conductive wire. The widened portion 18 may be located at a curved portion of the conductive wire that is curved inward.

A ratio w2/w1, in other words, a ratio of the maximum width w2 of the widened portion 18 to the width w1 of the conductive wire at a position other than the widened portion 18, is greater than 1 and smaller than or equal to 2 (i.e., from greater than 1 to 2). In addition, an upper edge 18*a* of the widened portion 18 is positioned below an upper edge 10*a* of the winding section 10, and lower edge 18*b* of the widened portion 18 is positioned above a lower edge 10*b* of the winding section 10.

On average, the thickness t2 of the widened portion 18 is, for example, about 50% to 90% of the thickness t1 of the conductive wire at position other than the widened portion 18. A length dl of the widened portion 18 is shorter than the longitudinal length of transition section 20. As described above, the length of the transition section 20 is shorter than the length of the innermost turn of the conductive wire in the winding section 10. Accordingly, the length dl of the widened portion 18 is shorter than the length of the innermost turn in the winding section 10.

One of the lead-out portions 16 is taken out from the upper stage 12 of the winding section 10, and the other one of the lead-out portions 16 is taken out from the lower stage 14. An end portion 16*a* of each lead-out portion 16 is exposed from the magnetic portion 6, which will be described later. It is desirable to expose the principal surface of the end portion 16*a* of each lead-out portion 16 from the magnetic portion 6.

Magnetic Portion

The coil 8 is embedded in the magnetic portion 6. At least part of the end portion 16*a* of each lead-out portion 16 is exposed from the magnetic portion 6. The magnetic portion 6 is formed by pressing a mixture of a magnetic powder and a resin. The magnetic powder content of the mixture is, for example, 60 weight % or more, preferably 80 weight % or more. The type of magnetic powder to be used is an iron-based magnetic powder, for example, composed of Fe, Fe—Si, Fe—Si—Cr, Fe—Si—Al, Fe—Ni, Fe—Ni—Al, Fe—Ni—Mo, or Fe—Cr—Al, an other magnetic powder based on a metal other than iron, an amorphous metal-based magnetic powder, a metal-based magnetic powder of which surfaces of metal particles are coated with an insulator such as glass, a metal-based magnetic powder of which surfaces of metal particles are modified, or a metal-based magnetic powder composed of nano-level minute metal particles. The type of resin to be used is a thermosetting resin, such as epoxy resin, polyimide resin, and phenol resin, or a thermoplastic resin, such as polyethylene resin and polyamide resin.

Main Body

As described above, the main body 2 includes the coil 8 and the magnetic portion 6. In external appearance, the main body 2 is shaped like a cuboid having, for example, a width of 1.2 mm or more to 3.2 mm or less (i.e., from 1.2 mm to 3.2 mm), a depth of 0.6 mm or more to 2.5 mm or less (i.e., from 0.6 mm to 2.5 mm), and a height of 0.6 mm or more to 1.8 mm or less (i.e., from 0.6 mm to 1.8 mm). At least part of end portions 16*a* of the lead-out portions 16 are exposed from respective opposite side surfaces 2*c* and 2*e* of the main body 2.

Outer Electrode

A pair of the outer electrodes 4 are formed on surfaces of the main body 2 so as to be spaced from each other. In the present embodiment, one of the outer electrodes 4 covers the side surface 2*c* and part of adjacent four side surfaces 2*a*, 2*b*, 2*d*, and 2*f* of the main body 2 and is electrically connected to the end portion 16*a* of one lead-out portion 16, which is exposed from the magnetic portion 6. The other one of the outer electrodes 4 covers the side surface 2*e* and part of adjacent four side surfaces 2*a*, 2*b*, 2*d*, and 2*f* of the main body 2 and is electrically connected to the end portion 16*a* of the other lead-out portion 16, which is exposed from the magnetic portion 6. The outer electrodes 4 are made, for example, of a conductive resin that contains metal particles and a resin. Silver particles are used as the metal particles, and an epoxy resin is used as the resin. The outer electrodes 4 may further include a plating layer formed on the conductive resin. The plating layer may have a first layer made of nickel and a second layer formed on the first layer and made of tin.

In the inductor configured as described above, the width w2 of widened portion 18 of the conductive wire is greater than the width w1 of the conductive wire at a position other than the widened portion 18. This increases the area serving to adhere the transition section 20 to the upper stage 12 and the lower stage 14, which can thereby increase the bonding strength between turns of the conductive wire. As a result, the shape of the coil 8 can be maintained appropriately. In addition, in the inductor configured as above, the thickness t2 of widened portion 18 of the conductive wire is smaller than the thickness t1 of the conductive wire at a position other than the widened portion 18. This can increase an effective inside diameter r of the coil 8 (see FIG. 2) and can thereby increase the inductance of the coil 8.

The coil of the inductor configured as above includes a winding section 10 that are formed by winding a conductive wire having an insulating cover and a pair of opposite principal surfaces into an upper stage 12 and a lower stage 14 that are connected to each other by an innermost turn of the conductive wire that serves as a transition section 20 while both ends of the conductive wire are located at an outermost turn of the conductive wire. The coil also includes a pair of lead-out portions 16 that are taken from respective outermost turns of the upper stage 12 and the lower stage 14 and that continue to respective ends of the conductive wire. In the coil, at least part of the transition section 20 includes a widened portion 18, and a width w2 of the widened portion 18 of the conductive wire is greater than a width w1 of the conductive wire at a position other than the widened portion 18.

Manufacturing Method

Figure 3:
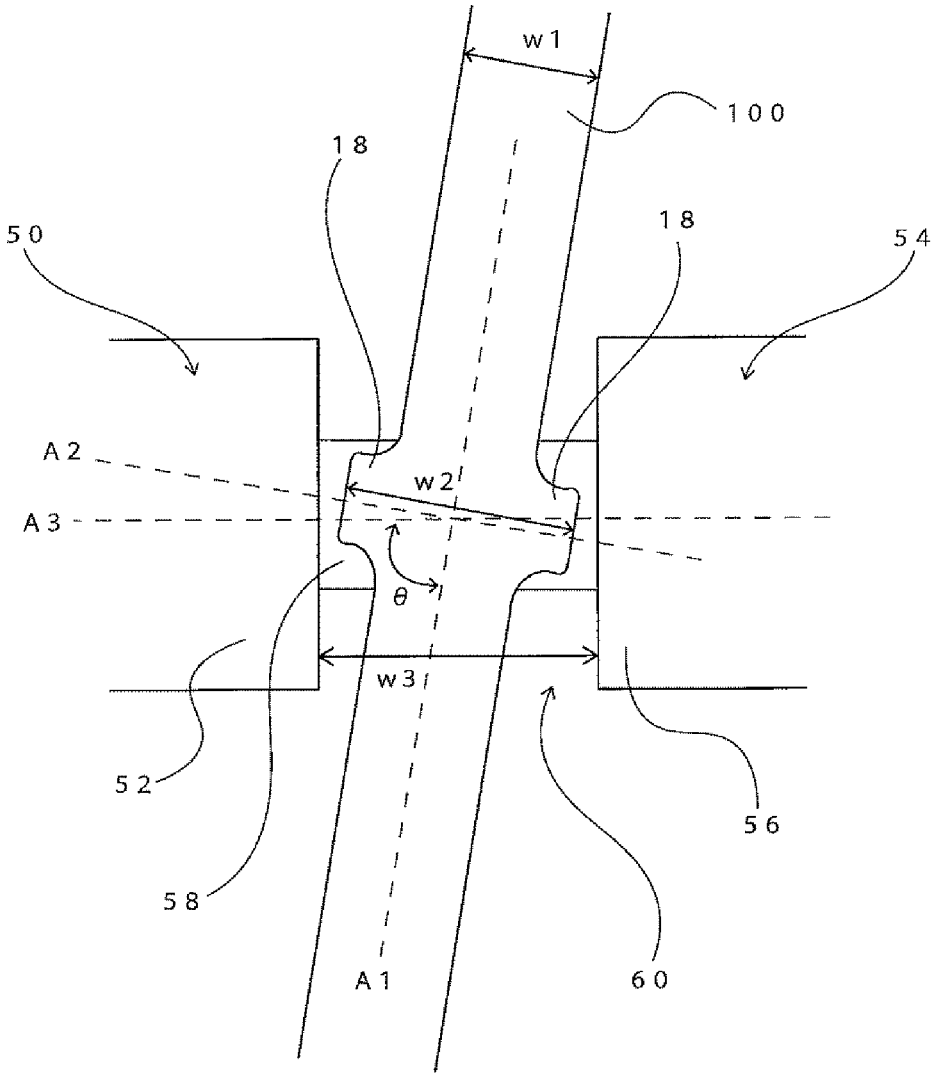
FIG. 3 is a view illustrating a manufacturing process of an inductor according to the embodiment.

Next, a method of manufacturing the inductor according to the embodiment will be described with reference to FIG. 3. FIG. 3 is a view illustrating a manufacturing process of the inductor according to the embodiment. The method of manufacturing the inductor according to the embodiment includes 1) a step of forming the coil 8, 2) a step of forming the main body 2, and 3) a step of forming the outer electrodes 4. These steps will be described in detail below.

Step of Forming Coil

In this step, the coil 8 having the winding section 10 and lead-out portions 16 is formed. The coil 8 is formed of a conductive wire 100 having a pair of opposite principal surface (so-called "flat wire"). The conductive wire 100 has a conductor, a cover layer having insulation properties formed on the surface of the conductor, and a fusing layer formed on the surface of the cover layer.

The coil 8 is formed using a jig 50 having a collar 52 and a jig 56 having a collar 54 and a columnar winding core 58 having an oval cross section. The winding core 58 of the jig 56 is abutted against the collar 52 of the jig 50 to form a winding groove 60. The coil 8 is formed by winding the conductive wire 100 around the winding core 58 in the winding groove 60.

More specifically, the coil 8 is formed in the following manner. First, the widened portion 18 is formed in advance by flattening a middle portion of the conductive wire 100 from one principal surface thereof. The widened portion 18 is thinner and wider than the other portion of the conductive wire 100. The widened portion 18 is formed so as to have a maximum width two times or less wider than the width w1 of the conductive wire 100 before flattened. In addition, the widened portion 18 is formed such that the length of the widened portion 18 is shorter than the circumference of the winding core 58. Moreover, it is desirable to flatten the conductive wire 100 only from one principal surface of the widened portion 18 so that the other principal surface of the widened portion 18 is flush with the same principal surface of other portion of the conductive wire 100. Note that in FIG. 3, the widened portion 18 is shaped so as to be symmetric with respect to a longitudinally extending central axis A1 of the conductive wire. The shape of the widened portion 18 is not limited to this. The widened portion 18 may be shaped so as not to be symmetric with respect to the central axis A1 insofar as the widened portion 18 can be in contact with wider areas of respective inner principal surfaces 12*a* and 14*a* of the upper stage 12 and the lower stage 14.

Next, as illustrated in FIG. 3, the widened portion 18 is placed on the winding core 58 at a position substantially in the middle between the jig 50 and the jig 56. Here, the conductive wire 100 is disposed on the winding core 58 in such a manner that the winding core 58 comes into contact with the principal surface of the widened portion 18 that has been flattened in the process of forming the widened portion 18. In addition, the conductive wire 100 is disposed in such a manner that the width direction A2 of the conductive wire 100 forms an angle with a central axis A3 of the winding core 58. It is desirable that an angle θ formed between the central axis A3 of the winding core 58 and the longitudinally extending central axis A1 of the principal surface of the conductive wire 100 be, for example, 80° or more and 89° or less (i.e., from 80° to 89°). It is also desirable that a width w3 of the winding groove 60 between the jig 50 and the jig 56, in other words, the length of the winding core 58, be set to be slightly greater than about twice of a width w1 of the conductive wire 100. Note that the widened portion 18 may be formed with the conductive wire 100 being abutted against the winding core 58 of the jig 56 when the conductive wire 100 is wound around the winding core 58.

Next, the conductive wire 100 is wound around the winding core 58 by turning each end portion of the conductive wire 100 around the winding core 58 by one turn. The transition section 20 of the winding section 10 is thus formed.

Subsequently, the upper stage 12 and the lower stage 14 are formed by winding respective end portions of the conductive wire 100 on top of the transition section around the winding core 58 by three-fourths turn.

Next, after the coil 8 is heated to fuse adjacent fusing layers together, the jig 50 and the jig 56 are separated, and the coil 8 is removed from the winding core 58 of the jig 56. In the present embodiment, both end portions of the conductive wire 100 are wound approximately by three-fourths turn because the coil 8 according to the present embodiment is the alpha-winding coil formed of 2.5 turns of the conductive wire 100. However, an alpha-winding coil having more than 2.5 turns can be formed by winding both end portions of the conductive wire 100 by a predetermined number of turns.

Lastly, the lead-out portions 16 are bent into desired shapes to provide the coil 8 according to the present embodiment.

Step of Forming Main Body

In this step, the coil 8 is placed in a cavity of a die, and the cavity is filled with a mixture of a magnetic powder and a resin. Here, the coil 8 is desirably placed in the cavity in such a manner that desired portions of the one and the other lead-out portions 16 come into contact with respective side surfaces of the cavity. The desired portions are portions to be desirably exposed from respective side surfaces 2*c* and 2*e* of the main body 2. In the case in which the principal surfaces of end portions 16*a* of respective lead-out portions 16 are exposed from the side surfaces 2*c* and 2*e* of the main body 2, the principal surfaces of the end portions 16*a* are brought into contact with the side surfaces of the cavity. The mixture of the magnetic powder and the resin in the die is heated to a softening temperature of the resin (for example, 60° C. or more to 150° C. or less (i.e., from 60° C. to 150° C.)) or higher. In this state, the mixture is molded and cured by pressing the mixture at an approximate pressure of 100 $kg/cm^2$ or more to 500 $kg/cm^2$ or less (i.e., from 100 $kg/cm^2$ to 500 $kg/cm^2$) while heating the mixture to a curing temperature of the resin (for example, 100° C. or more to 220° C. or less (i.e., from 100° C. to 220° C.)) or higher. The magnetic portion 6 and the coil 8 are thereby integrated into one piece, which forms the main body 2 with at least part of end portions 16*a* of the lead-out portions 16 being exposed from the side surfaces 2*c* and 2*e*. Note that the curing may be carried out after the molding is completed.

Step of Forming Outer Electrodes

In this step, a pair of outer electrodes 4 that are spaced from each other are formed on the side surfaces 2*c* and 2*e* of the main body 2 from which respective end portions 16*a* of the lead-out portions 16 are exposed and also on part of the other four surfaces 2*a*, 2*b*, 2*d*, and 2*f* adjacent to the side surfaces 2*c* and 2*e*. The outer electrodes 4 are formed by applying, by way of dipping, a fluid conductive resin, such as a conductive paste, to desired portions of the main body 2. The outer electrodes 4 may be formed by metal plating on the surfaces of the conductive resin applied. A nickel layer on the conductive resin and a tin layer on the nickel layer are formed by metal plating.

Figure 4:
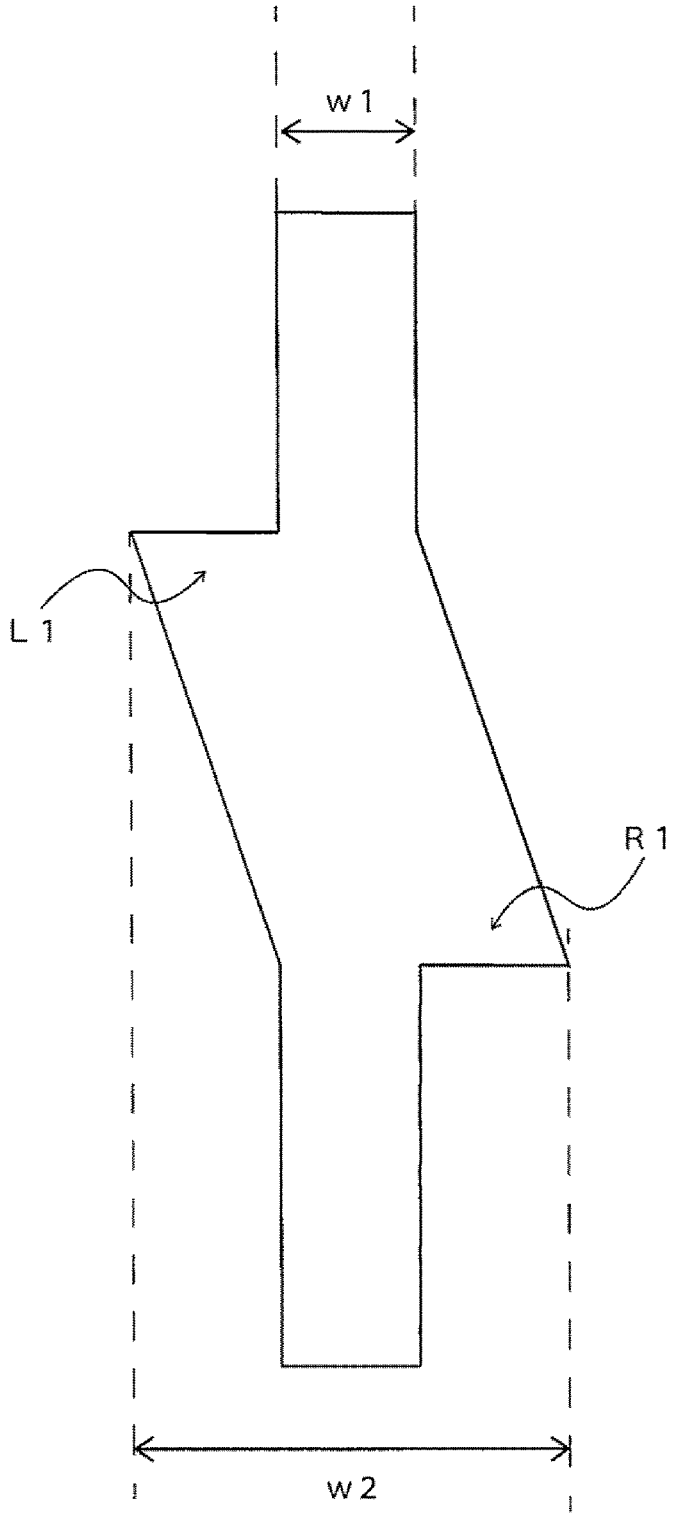
FIG. 4 is a development view illustrating a coil according to another embodiment of the present disclosure.

FIG. 4 is a development view illustrating a coil according to another embodiment of the present disclosure. As illustrated in FIG. 4, the widened portion may be formed so as to have substantially right-angled triangles L1 and R1 that flank the conductive wire and are arranged with point symmetry. In the above description, the coil 8 is formed by winding the conductive wire 100 by 2.5 turns. However, the number of turns of the conductive wire 100 is not limited to this. The present disclosure is advantageously applied to a coil having a small number of turns. For example, the number of turns of the conductive wire 100 is assumed to be 2.5 turns or more and 3.5 turns or less (i.e., from 2.5 turns to 3.5 turns).

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil comprising:

a winding section that includes a conductive wire having an insulating cover and a pair of opposite principal surfaces, the conductive wire being wound into an upper stage and a lower stage that are connected to each other by an innermost turn of the conductive wire that serves as a transition section while both ends of the conductive wire are located at an outermost turn of the conductive wire, at least part of the transition section including a widened portion, and a width of the widened portion of the conductive wire being greater than a width of the conductive wire at a position other than the widened portion; and a pair of lead-out portions that are taken from respective outermost turns of the upper stage and the lower stage and that is continuous to respective ends of the conductive wire, wherein an upper portion of the widened portion extends upward from upper sides of a portion of the upper and lower stages adjacent to the widened portion, and a lower portion of the widened portion extends downward from lower sides of the portion of the upper and lower stages adjacent to the widened portion.

2. The coil according to claim 1, wherein a thickness of the conductive wire in the widened portion is smaller than a thickness of the conductive wire at a position other than the widened portion.

3. The coil according to claim 1, wherein a ratio of the width of the widened portion to the width of the conductive wire at the position other than the widened portion is from greater than 1 to 2.

4. The coil according to claim 1, wherein a length of the widened portion of the conductive wire is smaller than a length of the innermost turn of the conductive wire in the winding section.

5. The coil according to claim 1, wherein a number of turns of the conductive wire in the coil is from 2.5 to 3.5.

6. An inductor, comprising:

a magnetic portion containing a magnetic powder and a resin; and the coil according to claim 1, the coil being embedded in the magnetic portion.

7. The coil according to claim 2, wherein a ratio of the width of the widened portion to the width of the conductive wire at the position other than the widened portion is from greater than 1 to 2.

8. The coil according to claim 2, wherein a length of the widened portion of the conductive wire is smaller than a length of the innermost turn of the conductive wire in the winding section.

9. The coil according to claim 3, wherein a length of the widened portion of the conductive wire is smaller than a length of the innermost turn of the conductive wire in the winding section.

10. The coil according to claim 7, wherein a length of the widened portion of the conductive wire is smaller than a length of the innermost turn of the conductive wire in the winding section.

11. The coil according to claim 2, wherein a number of turns of the conductive wire in the coil is from 2.5 to 3.5.

12. The coil according to claim 3, wherein a number of turns of the conductive wire in the coil is from 2.5 to 3.5.

13. The coil according to claim 4, wherein a number of turns of the conductive wire in the coil is from 2.5 to 3.5.

14. The coil according to claim 7, wherein a number of turns of the conductive wire in the coil is from 2.5 to 3.5.

15. The coil according to claim 8, wherein a number of turns of the conductive wire in the coil is from 2.5 to 3.5.

16. An inductor, comprising:

a magnetic portion containing a magnetic powder and a resin; and the coil according to claim 2, the coil being embedded in the magnetic portion.

17. An inductor, comprising:

a magnetic portion containing a magnetic powder and a resin; and the coil according to claim 3, the coil being embedded in the magnetic portion.

18. An inductor, comprising:

a magnetic portion containing a magnetic powder and a resin; and the coil according to claim 4, the coil being embedded in the magnetic portion.

19. An inductor, comprising:

a magnetic portion containing a magnetic powder and a resin; and the coil according to claim 5, the coil being embedded in the magnetic portion.

20. An inductor, comprising:

a magnetic portion containing a magnetic powder and a resin; and the coil according to claim 7, the coil being embedded in the magnetic portion.

* * * * *